United States Patent [19]

Kugler et al.

[11] 3,941,899

[45] Mar. 2, 1976

[54] METHOD OF COATING ELECTRODES

[75] Inventors: Tibor Kugler, Thayngen; Hans Wolfhart Rieger, Beringen, both of Switzerland

[73] Assignee: Swiss Aluminium Ltd., Switzerland

[22] Filed: Nov. 15, 1972

[21] Appl. No.: 306,632

[30] Foreign Application Priority Data

Nov. 16, 1971 Switzerland ..... 16605/71

[52] U.S. Cl. ..... 427/34; 427/113; 427/123; 427/126

[51] Int. Cl.[2] ..... B05D 5/12; B05D 1/00

[58] Field of Search ..... 117/93.1 PF, 228, 217, 117/227, 201; 204/290 R; 427/34, 126, 123, 113, 427

[56] References Cited

UNITED STATES PATENTS

| | | | |
|---|---|---|---|
| 3,243,313 | 3/1966 | Aves, Jr. | 117/105.2 |
| 3,310,423 | 3/1967 | Ingham, Jr. | 117/93.1 PF |
| 3,332,752 | 7/1967 | Batchelor | 427/427 |
| 3,348,929 | 10/1967 | Valtschev et al. | 117/228 |
| 3,349,722 | 10/1967 | Davis | 117/217 |
| 3,390,013 | 6/1968 | Rubisch | 117/228 |
| 3,442,786 | 5/1969 | Clukey et al. | 117/228 |
| 3,447,961 | 6/1969 | Hitchcock | 117/217 |
| 3,640,757 | 2/1972 | Grubba | 117/105.2 |

*Primary Examiner*—Cameron K. Weiffenbach
*Attorney, Agent, or Firm*—Robert Irving Williams

[57] ABSTRACT

A method of applying to an anode for use in fusion electrolysis a coating for protection of the anode against surrounding influences, comprising delivering the material of the coating in finely dispersed form onto the anode with sufficient heat content and impact energy to cause adhesion between the material and the surface of the anode and consolidation of the material. Preferably the material is applied by means of a plasma burner and, for an anode to be used for the electrolytic production of aluminium, includes aluminium oxide and facultatively aluminium, the thickness of the coating beeing about 0.1 to 1.0 mm.

5 Claims, No Drawings

METHOD OF COATING ELECTRODES

RELATED APPLICATIONS

This disclosure involves the use of aluminum oxide as set forth in our copending application Ser. No. 306,633, filed on even date herewith, now U.S. Pat. No. 3,829,374 issued Aug. 13, 1974.

BACKGROUND OF THE INVENTION

1. Field of the Invention

The invention relates to the manufacture of anodes which can be operated in a manner neutral to the surroundings, especially of anodes intended for cooperation with an electrolyte of a cell for production of aluminum by fusion electrolysis. The anodes have a layer applied on the anode surface consisting of a material which protects the anode surface against surrounding influences and dissolves in the electrolyte.

The cathodically connected pot of a fusion electrolysis cell for production of aluminum contains molten aluminum, and an electrolyte which floats on the aluminum and contains aluminum oxide; the electrolyte on its side directed towards the atmosphere forms a solid crust, and this in turn is covered with a layer of alumina ($Al_2O_3$) for periodical enrichment of the electrolyte and for thermal insulation of the bath. Anodes consisting of artificial carbon penetrate the alumina layer and the crust and extend into the electrolyte. The crust usually does not sealingly surround the circumference of each anode, but a gap forms around the anode circumference because of rising gases and other influences. The consumption of an anode during the operation of the cell, also known as burning away, which is made up of a primary and secondary burning, is based upon two oxidation mechanisms which should be considered separately for the present purpose.

In the primary burning, the oxygen released from the aluminum oxide during the fusion electrolysis attacks the carbon of the anode with formation of a gas mixture of carbon dioxide and monoxide, which mostly rises along the anode surfaces and through the gap.

This reaction, which brings about the majority of the burning away, occurs exothermically with heating of the electrolyte and reduction of the energy necessary for the electrolysis. This primary burning is unavoidable with carbon anodes.

On the contrary, this is not the situation with the secondary burning, which is based on another oxidation mechanism and which impairs economic cell operation. The present invention is concerned with resisting this secondary burning. The cause of secondary burning is as follows.

The temperature of the bath in the cell (i.e. the cathode pot) lies at about 950° to 980°C, and this source of heat imparts a heat content to the carbon anodes, so that a gradient is established between the side of the anode facing towards the bath and facing away from the bath. Corresponding to this heat content of the anodes, the surfaces of the anodes exhibit a corresponding temperature gradient between a maximum of 980°, and 400°C. At the same time the part of the anode extending out of the bath is surrounded with an atmosphere consisting of air, together with a gas mixture of carbon monoxide and dioxide and smaller quantities of vaporised fluorides rising mainly through the gap around the anode and burning in the air. Encouraged by the high temperature of the anode, this atmosphere has an oxidising effect, thus encouraging burning away. The burning reactions which thus occur produce, in contrast to the oxidation mechanism causing the primary burning, no contribution to the bath heating and thus to reduction of energy, but they produce unproductive losses of carbon which can, for a definite quantity of aluminum produced, amount to up to 8 % of the total consumption of anode carbon.

2. Description of the Prior Art

It is known to manufacture an anode which during its operation is substantially neutral to its surroundings, i.e. free of secondary burning away. This involves the application of a coating on the anode surfaces hindering oxidising media from attack on the anode surfaces extending out of the cell bath. In this method, an anode cladding is produced by casting of aluminum on the anode surfaces. In order that it can attain its intended function, this anode cladding has thickness of at leat one cm, but preferably several cms, and this requires considerable expenditure. A layer of this kind cannot be applied on the anode surface without moulds or similar means, which require a series of working operations which introduce expense and are mostly manual. To avoid the introduction of oxidation products, special measures must be observed as the melt is conducted to the casting process. Besides, one must ensure that the wetting of the carbon by aluminum, which is anyway not good, is not still further impaired by inappropriate procedure. As mentioned initially, the secondary burning amounts to up to 8% of the total consumption of carbon for a given quantity of aluminum produced, and if an economic benefit is to be obtained from elimination of the secondary burning, then the costs devoted to this elimination must be held within the range of the above-mentioned fraction of the carbon costs. The known method is economically unattractive.

SUMMARY OF THE INVENTION

The invention starts from this, and the object underlying it is to provide a method of formation of an anode which in operation is neutral to the surroundings, especially a carbon anode for the production of aluminum by fusion electrolysis, the expense of material of which in relation to the saving obtained by the elimination of secondary burning represents a minimum.

According to the invention this object is achieved in that the material of the coating is delivered in finely dispersed form onto the anode with sufficient heat content and impact energy to cause adhesion between the material and the surface of the anode and consolidation of the material.

By this means and even if several passes are necessary for the desired thickness of the coating the drawbacks inherent in known methods are eliminated, because the known measures, involving moulds, avoidance of oxide entrainment, and optimisation of wetting, are more expensive.

DETAILED DESCRIPTION

In an advantageous development of the method, the material is supplied in an ionised gas jet of high energy content (heat content plus kinetic energy), being finely dispersed therein, and is applied to the anode surface by means of the energy residing in the gas jet, with simultaneous heating of the said surface. This development has the advantage that by means of it the application and consolidation of the material is possible in one operation. The simultaneous heating of the anode surface, that is of a zone around the point of application, hinders any rebound of the applied layer, and, by means of shock heating, excludes the oxidation of the carbon or of a possible previously applied metal layer, e.g. an aluminium layer.

By "high energy content" of the ionised gas jet there is to be understood an energy amount sufficient for the fusion and subsequent deposition on the surface to be coated of the material to be applied. In an ionised gas jet the heat content may reach $10^5$ kcal/kg of gas; however this energy will be adjusted according to the kind of material to be applied. For example, for the application of a layer of aluminium in molten condition one will so adjust the energy content of the ionised gas jet, to match the technological properties of the aluminium, that the energy is optimum for application, but is not so great that the aluminium vaporises before it has reached the surface to be coated.

As a further development of the method, the material can be introduced in fluent form, i.e. in powder or in liquid form, into the gas jet. This is indicated, if the material to be applied is already available in the form mentioned.

A best possible protection of the anode surface against influences from the surroundings, especially against oxidation, in only attainable if the anode surface is covered with a protective layer which adheres well and is impermeable to gas. One should also require of this layer that, for avoidance of flaking and formation of cracks, it matches well the thermal expension of the anode, and it should consist of a material which dissolves in the electrolyte without creating impurity in it. The method can be carried out with an optimum economic advantage, if aluminium oxide is introduced into the gas jet. Aluminium oxide is economical and dissolves in the electrolyte without leaving impurities.

To improve the adhesion and stability of a protective layer consisting of aluminium oxide, aluminium oxide is preferably introduced into an ionised gas jet which is oxidising in character. With employment of a non-oxidising ionised gas jet one can attain at least partly the conversion of the aluminium oxide into an aluminium sub oxide ($Al_2O$) and oxygen, so that, just where it is required, an optimum adhesion and stability become unattainable. Nitrogen in the ionised gas jet leads, through the at least partial conversion of the aluminium oxide, to aluminium nitrides, which are undesired for formation of a protective layer with the best possible adhesion and stability, so that the employment of a nitrogen-free ionised gas jet is to be aimed at.

A layer of aluminium oxide formed with the above-mentioned means shows necessarily a certain open porosity, which to a limited extent could enable the secondary burning away to still occur. This can be eliminated, if the aluminium oxide is applied in a thickness of 0.1 to 1.0 mm, preferably of 0.2 to 0.5 mm. By the choice of the layer thickness, a statistical closing of the penetrating pores is achieved.

In another advantageous embodiment of the invention, intended for closing the pores, there is first applied a layer of aluminium with a thickness of 0.05 to 1.0 mm, and on this a layer of aluminium oxide. During operation, the aluminium layer oxidises because of the penetration of oxidising media through the pores, and this oxidation effects closing up of the pores.

In a further development of the invention, for the purpose mentioned there is applied a layer of aluminium with a thickness of 0.05 to 1.0 mm, and on this layer a cermet-type layer of aluminium oxide and aluminium with a thickness of 0.1 to 1.0 mmm. During the operation of the anode the aluminium of the cermet-type layer, and of the aluminium applied under the cermet-type layer, oxidises so causing closure of the pores that are present.

The application of a layer of the aluminium on the anode surface, onto which a layer of aluminium oxide or a cermet-type one, i.e. ceramic-metallic consisting of aluminium oxide and aluminium, is then to be applied, brings the advantage that, upon formation of cracks by mechanical influences on the coating, an automatic sealing of the cracks takes place, without additional means being necessary for the purpose.

According to a further ambodiment of the invention it is possible, for production of a coating which seals its pores during heating, to apply as material a cermet-type mixture of aluminium oxide and aluminium in a thickness of 0.1 to 1.0 mm. During operation, the aluminium oxidises and thus closes pores penetrating to the anode surface, thus excluding secondary burning.

As regards the mechanical and chemical properties of the cermet-type layer, satisfactory values are produced if the aluminium oxide and aluminium are applied in a ratio by weight of 10:1 to 2:1.

For production of an ionised gas jet both gas-stabilised and also water-stabilised plasma burners can be employed. In this connection a water-stabilised plasma burner with a minimum input of 40 kw, preferably of about 150 kw or higher, is preferred. Burners with inputs in this order of magnitude, which are obtainable according to the present state of technology exclusively with water-stabilised burners, ensure the simultaneous rapid heating of a sufficiently large zone around the point of application, so that any rebound of a relatively thick layer applied in molten condition, as well as any oxidation of the carbon and of a possible aluminium layer already applied on the carbon, are avoided, this being attributable to the shock heating produced by the high burner output.

Burners of this kind are not restricted by their construction to the introduction of only one material in the ionised gas jet. Thus it is possible to introduce one or more materials into the plasma burner, that is to say into the ionised gas jet, while according to the handling of the device a homogeneous or a heterogeneous material becomes applied as a coating. Therefore a device for ionisation of a gas jet, by reason of the adjustability of its output, is suitable for the production of an anode which is neutral to the surroundings, and which has a coating of aluminium oxide, or a coating consisting of an aluminium layer with a second layer applied on it of aluminium oxide, or a second layer of a cermet-type material, or finally a layer of cermet-type material alone.

The cost of the devices for ionisation of a gas jet is relatively slight in proportion to the advantages flowing from them by suppression of the secondary burning away, so that the purpose of the invention is still attained if, for example, two devices of the kind mentioned are employed for production of a coating consisting of an aluminium layer with a layer of aluminium oxide applied over it, one producing the aluminium layer and the other that of aluminium oxide.

Two devices for ionisation of a gas jet are also suitable for manufacture of a coating consisting of an aluminium layer with a cermet-type layer sprayed onto it.

In doing this, first aluminium is applied to the anode surface from one device, and then the cermet-type layer is built up with switching in of the second device, with combination of their discharges of aluminium and aluminium oxide, while the latter arrangement is also suitable for formation of a coating of a cermet-type layer alone. Alternatively, equally good results have been attained with reference to the economics of the method, if the aluminium layer is applied to the anode by flame spraying by means of an acetylene-oxygen mixture.

It has appeared that it is not possible to employ aluminium metal alone as a flame-sprayed oxidation resisting layer. The reason is that, although aluminium applied in this way develops a film of oxide on its exposed surface, the aluminium melts away as the anode is lowered into the bath, and the film of oxide which is left is not adherent to the anode and is fragile. Consequently, once the aluminium as melted, oxidising agents can reach the anode through breaks in the oxide layer.

In the application by means of an ionised gas jet, the best rate of application, defined as ratio of applied material to rejected material, and the best adhesion and impermeability of the coating, are obtained if the gas jet is arranged and delivered perpendicular to the surface to be protected.

Methods according to the invention produce a high economic advantage from the elimination of the secondary burning. Moreover variations are possible, for production of the coating of best possible formation for overcoming the secondary burning, which do not impair the economic advantages.

DESCRIPTION OF PREFERRED EMBODIMENTS

Below are some examples of methods in accordance with the invention. These examples also involve the use of aluminium oxide in accordance with our said copending Patent application.

EXAMPLE 1

On a carbon anode for aluminium electrolysis, those surfaces that are to be protected are first preferably lightly sand sprayed with corundum sand. A layer about 0.4 mm thick of aluminium oxide is applied in molten condition by means of a water-stabilised plasma burner of 150 kw power input and a spray output of about 20 kg per hour, in four successive traverses with cross-wise coverage of the surface. The distance of the anode of the plasma burner from the surface of the carbon anode amounts to 25 to 30 cm. The rate of deposition of the aluminium oxide amounts to about 16 kg per hour. The aluminium oxide which is not deposited is sucked up, collected and delivered back to the process. The grain size of the aluminium oxide amounts to 75 to 150 $\mu$.

EXAMPLE 2

The surface to be protected of a usual carbon anode for aluminium electrolysis is preferably lightly sand sprayed with corundum sand. A layer of aluminium about 0.1 mm thick is applied with the help of a metallisation burner. Directly thereupon a layer of $Al_2O_3$ about 0.3 mm thick is applied with the help of a water-stabilised plasma burner with a power input of 150 kw and a spray output of 20 kg per hour by successive traversing of the surface three times with the plasma flame, while the distance of the anode of the plasma assembly from the surface of the carbon anode amounts to 25 to 30 cm. The deposition efficiency of the $Al_2O_3$ amounts to about 80%. The applied $Al_2O_3$ (industrial alumina) has a grain size of 75 to 150 $\mu$.

EXAMPLE 3

The surface to be protected is provided, as described in Example 2, with a layer about 0.1 mm thick of aluminium metal. Then a quantity of about 20 kg $Al_2O_3$ and about 5 kg aluminium metal per hour is applied with the help of a water-stanilised plasma burner of 150 kw power input which is supplied with a continuously fed aluminium wire anode of 3.5 mm diameter, with formation of a cermet-type layer of about 0.4 mm thickness. The remaining conditions correspond entirely with those given in Example 2.

EXAMPLE 4

The surface to be protected is sand sprayed as described in Example 1, and thereupon is plasma coated with a quantity of about 7 kg aluminium and about 20 kg $Al_2O_3$ per hour with the help of a water-stabilised plasma burner of 150 kw power input, which is provided with a continuously fed aluminium wire anode of 3.5 mm diameter, with formation of a cermet-type layer of about 0.5 mm thickness. The separation beween the surface and the aluminium wire anode amounts to 20 to 25 cm; the layer is applied by traversing of the plasma flame four times over the surface. As in the other examples, one must here also observe that the plasma jet is directed as perpendicularly as possible onto the surface of the carbon anode.

What is claimed is:

1. A method of applying to a carbon anode for use in fusion electrolysis a coating for protection of the anode against surrounding influences, comprising delivering aluminium oxide and aluminium in finely dispersed form onto the anode with an oxidizing ionised gas jet having sufficient heat content and impact energy to cause adhesion between the coating and the simultaneously heated surface of the anode and consolidation of the coating, wherein the coating consists of a cermet-type layer of aluminium oxide and aluminium with a thickness of 0.1 to 1.0mm., and wherein the cermet-type layer is formed of aluminium oxide and aluminium in a ratio by weight of 10:1 to 2:1.

2. A method of applying to a carbon anode for use in fusion electrolysis a plural layered coating for protection of the anode against surrounding influences, comprising applying a layer of aluminium and a cermet type layer of aluminium oxide and aluminium in finely dispersed form onto the anode wherein said layer of aluminium with a thickness of 0.05–1.0 mm. is first applied, and then said cermet type layer of aluminium oxide and aluminium with a thickness of 0.1–1.0 mm. is applied with an oxidizing ionised jet having sufficient heat content and impact energy to cause adhesion between the coating and the simultaneously heated surface of the anode and consolidation of the coating.

3. A method of applying to a carbon anode for use in fusion electrolysis plural layered coating for protection of the anode against surrounding influences, comprising applying a layer of aluminum and a layer of aluminium oxide and aluminium in finely dispersed form onto the anode with an oxidizing ionised jet having sufficient heat content and impact energy to cause adhesion between the coating and the simultaneously heated surface of the anode and consolidation of the coating.

4. A method according to claim 3 wherein a layer of aluminum with a thickness of 0.05–1.0 mm. is first applied to the electrode as in claim 3 and then a layer of aluminum oxide with a thickness of 0.1–1.0 mm. is applied as set forth in claim 3.

5. A method according to claim 3, wherein the material is introduced into the gas jet in powder or liquid form.

* * * * *